United States Patent [19]

Place

[11] 4,381,607

[45] May 3, 1983

[54] CARPENTER'S TOOL

[76] Inventor: Christopher L. Place, 190 Woodhill Rd., Narragansett, R.I. 02882

[21] Appl. No.: 263,105

[22] Filed: May 13, 1981

[51] Int. Cl.[3] ..... B43L 7/00

[52] U.S. Cl. ..... 33/1 G; 33/1 LE; 33/339; 33/413; 33/453

[58] Field of Search ..... 33/1 G, 1 N, 1 LE, 339, 33/340, 341, 342, 343, 413, 414, 451, 453

[56] References Cited

U.S. PATENT DOCUMENTS

| | | | |
|---|---|---|---|
| 1,399,963 | 12/1921 | Hogg | 33/453 |
| 2,507,460 | 5/1950 | Schacht | 33/453 |
| 2,524,596 | 10/1950 | Kamp | 33/413 |
| 2,788,584 | 4/1957 | Adrien | 33/1 LE |
| 2,966,743 | 1/1961 | Doudlah | 33/1 N |
| 3,066,416 | 12/1962 | Gutting | 33/1 LE |
| 3,514,863 | 6/1970 | Moll | 33/1 LE |

FOREIGN PATENT DOCUMENTS

| | | | |
|---|---|---|---|
| 573483 | 2/1958 | Italy | 33/451 |

*Primary Examiner*—Richard R. Stearns
*Attorney, Agent, or Firm*—Robert J. Doherty

[57] ABSTRACT

A tool for use by carpenters and the like for conveniently establishing a reference line on a working surface at a predetermined angular disposition from an established base line on said surface. The tool includes an elongated member from which angle lines or cords are each adapted to extend a predetermined distance such that the intersecting terminal ends of such cords in combination with the member, form a triangle having sides of known length. Inasmuch as the length of the triangle's sides are known, the angles included thereby are also known such that a chalked line connected to the member may be utilized to establish a reference line at a known angular disposition to the member. The tool has particular utility when it is desired to establish the angular relationship of a wall to be built with respect to an already existing wall.

10 Claims, 6 Drawing Figures

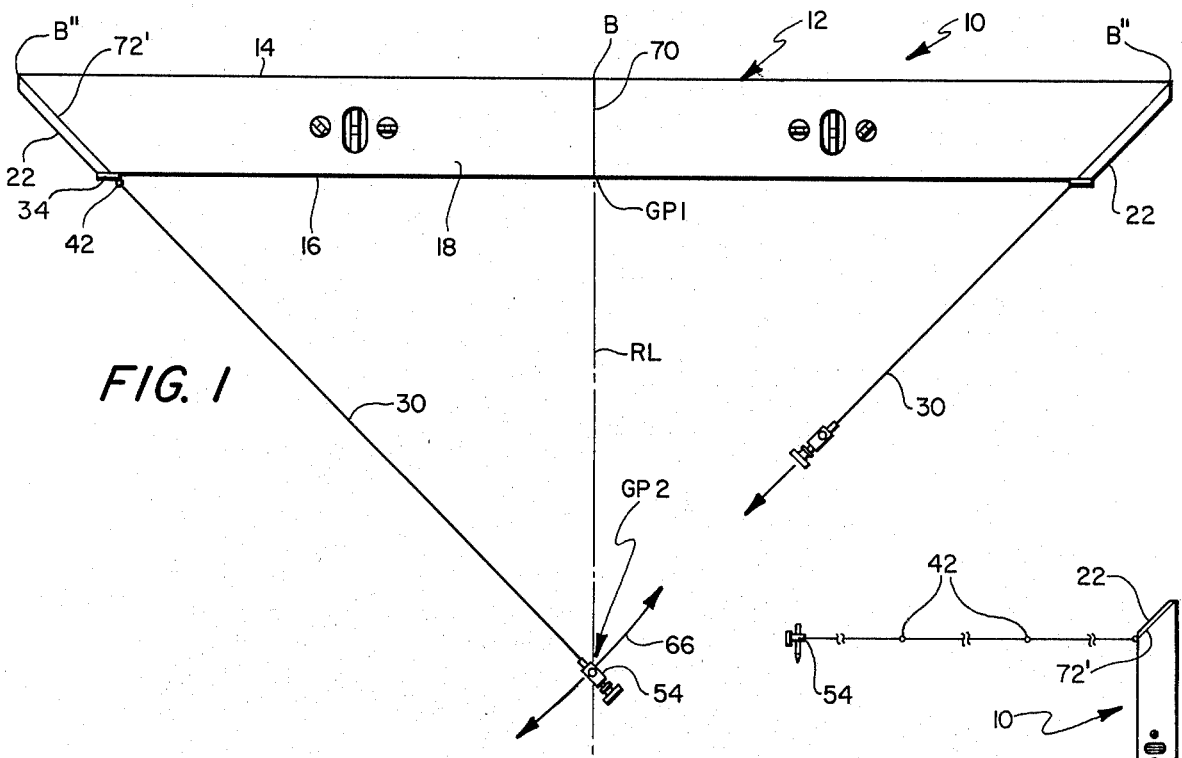
FIG. 1
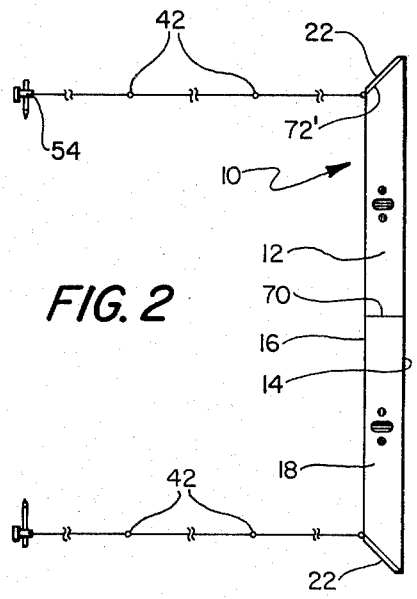
FIG. 2
FIG. 3
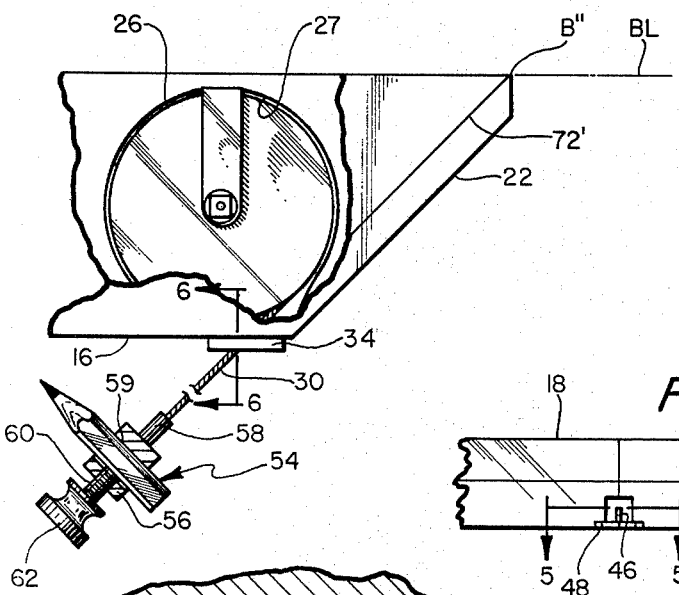
FIG. 4
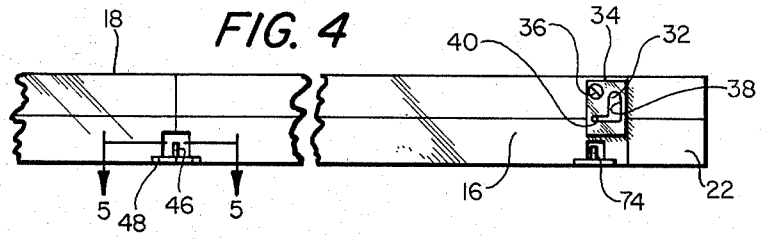
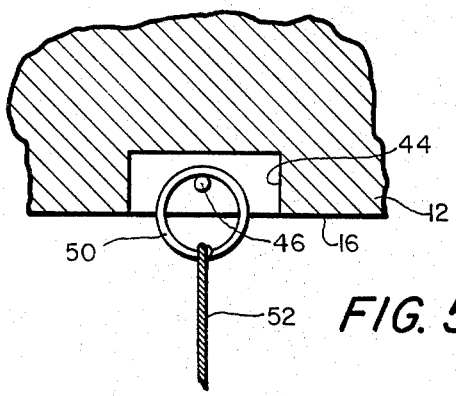
FIG. 5
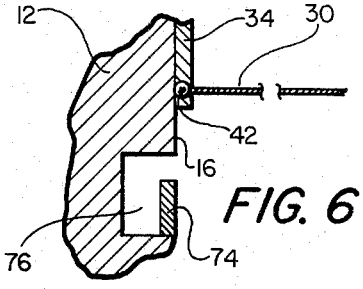
FIG. 6

CARPENTER'S TOOL

BACKGROUND AND SUMMARY OF THE INVENTION

This invention relates to a device or tool for establishing a marked line at a known angular relationship to an already established line and has particular utility in the field of carpentry although not necessarily limited thereto. When it is desired to build a wall at a certain angular relationship (normally 90°) from an already existing wall, the carpenter or other craftsman will either by the use of a protractor, square or other angle measuring device, mark two or more reference points on the subfloor and thereafter by use of a taut chalked line snap a reference line along those points so as to establish a marked line at the desired angle with the existing wall. This leads to inherent inaccuracies inasmuch as the square, protractor or other angle measuring device is normally relatively small for ease in portability and therefore can only establish spaced points a relatively short distance from the wall such that when the reference line is formed by passing through those points, substantial inaccuracies can occur especially if the wall or other structure is to be built of a considerable length.

One possible way to at least partially overcome this problem would be to utilize a line marker of the construction shown in U.S. Pat. No. 2,524,596 issued Oct. 3, 1950. Such a device is, however, primarily limited to bisecting an angle and accordingly forming a 90° reference line from a base line and is of undesirably cumbersome construction. An addition desirable feature of the present invention would be to provide a device which similarly is not limited in the formation of 90° reference lines but is able to equally form reference lines at other angles, e.g., 45°, 60°, etc.

Other patents of which the present applicant is aware but which are also believed to have only incidental bearing on the present invention are U.S. Pat. No. 2,507,460 issued May 9, 1950 and U.S. Pat. No. 756,632 issued Apr. 5, 1904.

It would accordingly be desirable to provide a device or tool of the above-described type which can conveniently and easily form a reference line with respect to an already established base line at various predetermined angles and which line has a great degree of accuracy over the entire length of the established reference line. These and other objects of the present invention are accomplished by a tool including an elongated member having generally parallel front and rear walls, said rear wall adapted for disposition along said established base line, a pair of angle lines each mounted on support means in turn attached to said member, said angle lines adapted for respective extension and retraction with respect to the front wall of said member at a pair of spaced locations therealong, a marking line associated with said member and adapted for extension from said front wall thereof at a first guide point centrally intermediate the locations where said angle lines are adapted to extend from said member front wall, and means associated with said angle lines to predetermine the respective lengths that said lines extend from said front wall thereof such that the intersection of said angle lines in front of said member defines a second guide point such that said marking line will define said predetermined angle with said member front wall when aligned along first and second guide points.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention:

FIG. 1 is a plan view showing the device of the present invention disposed so as to form a 90° reference line with respect to an already established base line;

FIG. 2 is a plan view similar to FIG. 1 but showing the manner in which the length of the angle lines may be varied;

FIG. 3 is a plan view partially broken away and on an enlarged scale showing the construction of one end of the device of the present invention;

FIG. 4 is a partial front elevational view of the tool shown in FIG. 1 of the drawing;

FIG. 5 is a sectional view taken along the line 5—5 of FIG. 4; and

FIG. 6 is a sectional view taken along the line 6—6 of FIG. 3.

DESCRIPTION OF THE INVENTION

Referring now to the drawing and in particularly FIG. 1 thereof, the overall structure of the tool 10 of the present invention is shown. Therein, the tool 10 includes a member 12 of elongated configuration formed conveniently from wood such as from a 2×4, from high impact strength plastic material as by injection molding or other materials suitable to the work place in which the tool is adapted for use. The member 12 includes a rear wall 14 and a front wall 16 interconnected by a top wall 18 as well as a bottom wall (not shown). The opposite ends of the member 12 terminate in end faces 22 which are inwardly directed from the rear wall 14 to the front wall 16 at an angle of 45°.

A spring reel 26 is mounted proximate each end of the member 12 in a pocket 27 provided for such purpose or in the hollow interior of the member when constructed in such manner. The reel is mounted for rotation on a fixed post 28 and is adapted to receive a flexible, nonelastic cord 30. The cords 30 project from the recess or hollow member interior and thence through a keyhole-shaped opening 32 formed within a face plate 34 in turn attached to the front wall 16 of the member 12 as by a screw 36 or other convenient means. The opening 32 includes a main portion 38 and an inwardly extending slot 40. The main portion 38 and the slot 40 are such that the cord 30 will easily pass through the slot 40 but stops 42 fixedly attached to the cord 30 at predetermined distances therealong may pass through the main opening 38 but not the slot 40. Thus in extending the cords 30 forwardly of the front wall 16, they may be withdrawn any desired distance indicated by one or more stops 42, but when the cord 30 is disposed within the slot 40, spring retraction of the cord 30 by the reel 26 will be limited by the abutment of the stop 42 against the face plate 34. In this manner, the exact length of the cord 30 extending beyond the front wall 16 of the member 12 can be determined by placing the stops 42 at previously determined incremental distances, e.g., at 4 foot intervals. It is also possible to utilize markings as by color bands at predetermined intervals along the cords 30 when combined with means for releasably clamping the cord in a fixed position (not shown). Also any suitable reel of known contruction may be utilized as long as it serves to store cord and release it when desired although the type of reel which continually urges the cord to its retracted wound position is preferred. It should also be pointed out that the reel could be of the type provided with a crank handle for winding the cord.

In any event, the inner extremity of the slot 40 contacts the cord 30 as it extends outwardly of the front wall 16 of the member. The member 12 is also provided with a recess 44 inwardly extending from the front wall 16 at a location centrally intermediate the locations at which the angle cords 30 are adapted to outwardly extend from the front wall 16. Such recess includes an upstanding pin 46 which may be mounted on a plate 48 and which terminates at a point well below the upper limit of the recess 44 such that a ring 50 may be detachably mounted thereon. A mason's chalk line or other cord 52 is attached to the ring 50 and is adapted to extend forwardly of the front face 16. The cord 52 is of an appropriate length such that it may extend from its connection to the pin 46 so as to form a first guide point, and through the point at which the cords 30 arcuately intersect with each other at a second guide point. In order to enable the cords to form intersecting arcuate marks on the working surface such as a subfloor of a building and the like, they are each provided at their terminal end with a marking assembly 54. Such marking assembly includes a body 56 fixedly attached to the terminal end of the cord as by a clenched tube 58 through which a bore 59 extends. A second but threaded bore 60 extends from the opposite side of the body 56 and communicates with the bore 59 and is adapted to hold a thumb screw 62. A pencil or other marking element is adapted to extend into the bore 59 and to be held fixedly therein by means of the thumb screw 62. Alternatively, other marking elements or assemblies may be utilized.

An example of how the above tool may be utilized to form a reference line RL with respect to an already established base line BL may be illustrated by reference to FIG. 1 of the drawing. Therein the rear wall 14 of the member 12 is placed on the base line, e.g., an already formed wall. Thereafter the right and left hand cords 30 are outwardly projected an equal distance, e.g., each four feet, and thereafter the marking assembly 54 of each utilized to form an arcuate line 66 on the working surface, i.e., the floor of the partially completed building. Such intersection of the arcuate lines 66 forms the second guide point (G P 2). Inasmuch as the upstanding pin 46 is equally intermediate the points which the cords 30 extend from the front wall 16; the marking line 52, when connected to the upstanding pin 46 so as to pass through the first guide point (G P 1) when extended through the second guide point (G P 2) will form two equal back to back triangles and thus establish a reference line (RL) outwardly extending from the front wall of the member 12 at exactly a 90° angle.

Similarly, by providing stops 42 at various other known lengths to correspond to the sides of appropriate triangles, reference lines extending from the first guide point at any appropriate angle can be established. However, inasmuch as 90° and 45° are the most commonly utilized angles, most devices of this type would be appropriately provided with bench marks and indicia lines to correspond with such angles. In this regard, it should be pointed out that the upper surface 18 of the member 12 is provided with a 90° score or indicia line 70. The score line 70 intersects the rear wall 14 at a bench mark B. The ends of the member 12 may also be provided with 45° indicia lines 72' which intersect the rear wall 14 at bench marks B'' for the purpose which will be hereinafter more fully explained. In establishing a reference line RL outwardly from a base line BL, the appropriate bench mark B or B'' is aligned at that location on the base line BL at which the wall cut or other structure desired to be established is to be situated and thereafter the cords 30 extended the appropriate distance, the arcuate lines 66 made and the interconnection thus formed guide points 1 and 2 made by the marking cord 52 for a 90° angle and made by one of the cords 30 for a 45° angle. Thus when making a 90° angle, the guide points 1 and 2 are aligned by drawing out the cords 30 an equal distance, e.g., 4 ft., 5 ft. 7¾ inches, or 10 ft. but when making a 45° angle one of the cords is drawn out 4 ft. and the other 5 ft. 7¾ inches so that a triangle is formed which includes a 45° angle between bench mark B'' and guide point 2. Of course other lengths of the cords 30 could be selected by appropriate placement of the stops 42 so that the 45° angle originated through guide point one (G P 1) if desired.

Turning now to FIG. 6 of the drawing in particular, it will be seen that secondary pins 74 are positioned within recesses 76 formed beneath the location of the guide plates 34 such that the pins 74 and the inward extent of the guide slot 40 are in vertical alignment with each other. A secondary 45° marking line or score 72' is formed in the upper wall 18 and extends from bench mark B'' at a 45° angle through the location of the pin 74. Thus by using either of the cords 30 as a marking line, a 45° line may be established from the base line from either of the secondary bench marks B''.

Also and as best shown in FIGS. 1 and 2, the member 12 is provided with a series of spirit levels such that the tool 10 may be placed in horizontal, vertical and 45° angle relationships so as to increase the flexibility and usefullness thereof especially when utilizing the tool in unusual or one of a kind situations. It also should be indicated that it may be useful to color code the various stops 42, i.e., a first stop of each cord could be labeled green at a four foot mark, a second stop orange at five foot 7¾ inch mark, and a third stop red at a ten foot mark. Also when utilizing the device to form reference lines at desired angles with respect to a base line already formed as by an existing wall, an already cut line of linoleum or floor tile, etc. that by utilizing cords 30 extended a greater distance (provided that the ratio between left and right cords is the same) the accuracy of such predetermined angle may be increased provided, of course, that the working surface facilitates such increased cord length.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A tool for conveniently marking a reference line on a working surface at a predetermined angular dispostion from an already established base line on said surface, said tool including an elongated member having generally parallel front and rear walls, said rear wall adapted for disposition along said established base line, a pair of angle lines each mounted on support means in turn attached to said member, said angle lines being extendable and retractable with respect to the front wall of said member at a pair of spaced locations therealong, a marking line associated with said member and extendable from said front wall thereof at a first guide point, and means associated with said angle lines to predetermine the respective lengths that said lines extend from said front wall thereof such that the intersection of said angle lines in front of said member defines a second guide point such that said marking line will define said predetermined angle with said member front wall when aligned along said first and second guide points.

2. The tool as set forth in claim 1, wherein said angle lines are flexible, non-extensible cords which are spring extendable and retractable.

3. The tool as set forth in claim 2, said angle lines support means being spring biased reels disposed within said member proximate the opposite ends thereof.

4. The tool as set forth in claims 1 or 3, a guide plate attached to said member front wall at said pair of spaced locations, said plates having an inwardly longitudinally directed guide slot adapted to contact said angle lines at an inner surface thereof so as to position the point at which said lines leave said front wall, each said slot extending into a main opening, said means associated with said lines for determining the extension length from said front wall being stops fixedly connected to said lines and of an X-section larger than said slot but less than said main opening whereby said line may pass freely through said openings but not said slot.

5. The tool as set forth in claim 4, wherein there is a secondary attachment element positioned beneath and in vertical alignment with the inner extent of said slot and wherein the ends of said member terminate in inwardly directed end walls disposed of said member at a 45° angle to said rear wall and reference indicia lines extending along an upper wall connecting said front and rear walls and in a vertical plane extending from each rear wall corner through a respective secondary attachment element.

6. The tool as set forth in claim 1, said first guide point comprising an attachment element associated with said front wall such that said marking line may be easily connected to and removed therefrom, said marking line being a chalked line, said rear wall having a reference point aligned with said attachment element at said predetermined angular disposition, said predetermined angular dispostion being 90°.

7. The tool as set forth in claim 6, said member having an upper wall connecting said front and rear walls, said upper wall including a 90° reference indicia line interconnecting said reference point and said attachment element.

8. The tool as set forth in claim 6, said attachment element being an upstanding pin disposed within a recess formed in said front wall.

9. The tool as set forth in claim 1, said angle lines having marking means at their terminal ends such that the intersection point of their respective arcuate paths may be delineated on said working surface.

10. The tool as set forth in claim 1, said elongated member having horizontal, vertical and 45° angle level indicators mounted thereon.

* * * * *